US007064275B2

(12) United States Patent
Henriott et al.

(10) Patent No.: US 7,064,275 B2
(45) Date of Patent: Jun. 20, 2006

(54) CABLE MANAGEMENT DEVICE

(75) Inventors: Jay M. Henriott, Jasper, IN (US); Mark A. Wahl, Santa Claus, IN (US); Lisa A. May, Jasper, IN (US); Douglas B. Prickett, Jasper, IN (US); Timothy S. Binkley, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 10/455,664

(22) Filed: Jun. 5, 2003

(65) Prior Publication Data

US 2004/0026103 A1 Feb. 12, 2004

Related U.S. Application Data

(60) Provisional application No. 60/386,919, filed on Jun. 7, 2002.

(51) Int. Cl.
*H02G 3/00* (2006.01)

(52) U.S. Cl. ..... 174/100; 174/135; 174/68.1; 439/470

(58) Field of Classification Search ..... 174/100, 174/135, 68.1, 68.3, 70 C; 439/470, 471, 439/472

See application file for complete search history.

(56) References Cited

U.S. PATENT DOCUMENTS

| | | | | |
|---|---|---|---|---|
| 1,861,151 A | | 5/1932 | Buschman | |
| 2,160,713 A | | 5/1939 | Bentley | 174/53 |
| 2,854,501 A | | 9/1958 | Ludwig | 174/53 |
| 2,913,740 A | | 11/1959 | Eldridge | 5/317 |
| 3,783,175 A | | 1/1974 | Timmons | 174/48 |
| 4,059,321 A | * | 11/1977 | Rasmussen et al. | 439/131 |
| 4,067,635 A | | 1/1978 | Solberg | 339/119 R |
| 4,718,741 A | | 1/1988 | Nichoalds | 312/223 |
| 4,863,398 A | | 9/1989 | Steenton et al. | 439/538 |
| 5,066,247 A | | 11/1991 | Watson | 439/565 |
| 5,167,047 A | | 12/1992 | Plumley | 16/2 |
| 5,562,341 A | | 10/1996 | Strauss | 362/226 |
| 5,709,156 A | | 1/1998 | Gevaert et al. | 108/50 |
| 5,765,932 A | | 6/1998 | Domina et al. | 312/223.6 |
| 5,885,098 A | | 3/1999 | Witkowski | 439/369 |
| 5,954,525 A | * | 9/1999 | Siegal et al. | 439/131 |
| 5,980,279 A | | 11/1999 | Muller | 439/142 |
| 6,024,599 A | | 2/2000 | Stathis et al. | 439/535 |

(Continued)

*Primary Examiner*—Dhiru R. Patel
(74) *Attorney, Agent, or Firm*—Baker & Daniels

(57) ABSTRACT

A cable management device traps and provides support for at least one electrical cable end connector which is located below an existing cable management hole through a work surface. In one embodiment, the cable management device includes a plate defining at least one aperture adapted to releasably receive an electrical connector. The plate is mountable directly to an underside of the work surface across a portion of the existing cable management hole such that the electrical connector is accessible from the top side of the work surface. Another embodiment of the cable management device includes a cylindrical sleeve adapted for mounting in a standard size cable management hole in a work surface, the sleeve including a lip protruding outwardly at a first end, the lip retaining the sleeve in the cable management hole, and at least one aperture defined by the sleeve, the aperture adapted to releasably receive an electrical connector.

22 Claims, 6 Drawing Sheets

U.S. PATENT DOCUMENTS 6,028,267 A 2/2000 Byrne ..... 174/59
6,082,840 A 7/2000 Chau et al. ..... 312/223.6
6,162,092 A 12/2000 Lin ..... 439/574
6,200,155 B1 3/2001 Chudkosky et al. ..... 439/371
6,254,206 B1 7/2001 Petrick et al. ..... 312/223.6
6,325,707 B1 * 12/2001 Rambeau ..... 451/296
6,393,658 B1 * 5/2002 Chong ..... 16/2.2
6,428,181 B1 * 8/2002 Moriarty ..... 362/154

* cited by examiner

CABLE MANAGEMENT DEVICE

CROSS REFERENCE TO RELATED APPLICATIONS

This application claims the benefit under Title 35, U.S.C. § 119(e) of U.S. Provisional Patent Application Ser. No. 60/386,919, entitled CABLE MANAGEMENT DEVICE, filed on Jun. 7, 2002.

BACKGROUND OF THE INVENTION

1. Field of the Invention

The present invention relates to a cable management device for work surfaces, such as a desk or credenza top. Specifically, the cable management device relates to managing electrical, telephone, and data cables and connectors which are routed through a cable management hole in the work surface.

2. Description of the Related Art

Known cable management devices for routing cabling through a work surface generally include a decorative grommet or cap having an opening to allow a cable to pass therethrough, or include a pop-up or fixed electrical outlet extending from a cable management hole and protruding above the work surface.

One such known device includes a cylindrical sleeve that extends the depth of a cable management hole through a work surface. Additionally, the device includes a disk-shaped cap or grommet which defines an opening along its circumference to accommodate the passage of cables therethrough. The sleeve and grommet combination functions to secure a cable passing therethrough and to provide a decorative closure to the cable management hole through the work surface. However, such cable management devices do not provide support for a socket or other connector on an electrical cable. Therefore, connection or disconnection of the cable sockets must be inconveniently completed from the space under the work surface, often by requiring a user to crawl under the work surface.

Other known cable management devices provide electrical cable routing through a cable management hole in a work surface by providing a pop-up or fixed element extending from the cable management hole and protruding above the work surface. Such elements generally house one or more electrical sockets which are permanently wired into the units. Thus, an electrical cable and associated plug can be connected to the socket above the work surface. However, such devices are rather expensive, and do not provide for storage of excess cable length associated with the cable plugged into the element. Additionally, the socket element also protrudes above the work surface in an unsightly and inconvenient manner.

Another known device includes a housing and a cover which fastens into a cable management hole in a work surface. The housing extends below the work surface and includes a receptacle unit having power receptacles and communication terminals and the associated cabling extending to power and data sources. The receptacle unit does not support easy installation or removal of power outlets and data connectors and does not support standard AC power cords, but rather requires specially shaped outlets and connectors that snap into position or outlets and connectors that are permanently fixed to the receptacle unit. Additionally, the housing does not fit in a standard sized cable management hole found in most work surfaces.

BRIEF SUMMARY OF THE INVENTION

With the increased usage of laptop computers and other portable electronic devices, it is becoming increasingly important to provide electrical and communication links at the work surface of a desk, thus allowing a user to make electrical and data connections without having to crawl under the desk. The present invention provides a cable management device which traps and supports electrical cords and telephone/data cable ("data") end sockets or other connectors immediately below an opening through a work surface, for example, below a cable management hole. Additionally, the cable management device provides for simple insertion and removal of standard AC power cord female sockets and standard data connectors of various size. The device also allows for the installation of a decorative grommet or cap above the supported sockets, specifically, at the work surface opening to the cable management hole.

A first embodiment of the inventive cable management device provides a plate for supporting at least one electrical socket or other connector. The plate defines at least one aperture sized to releasably receive an electrical connector, such as an AC power cord socket or a data connector. The plate may be fastened directly to the underside of a work surface across a portion of a cable management hole extending through the work surface. Additionally, the plate may define one or more vertical protrusions which extend slightly above the surface of the plate and align the plate relative to the circumference of the hole so that the apertures are properly aligned with the cable management hole. A decorative or other grommet or cap may be placed in the cable management hole to conceal the attached plate. A power plug or data plug may be threaded through the decorative cover and connected to the power socket or data connector supported by the device.

A second embodiment of the cable management device includes a cylindrical sleeve having an outwardly depending lip at a first end and a bottom end closing off the cylindrical sleeve at a second end. The sleeve slides into a standard sized cable management hole and is supported by the lip at the first end substantially flush with the work surface. The bottom end defines one or more apertures shaped to releasably receive an electrical connector such as a standard AC power cord socket or data connector. The length of the cylindrical sleeve is such that a power plug or data connector plugged into the supported power socket or data connector is contained within the cylindrical sleeve between the first and second ends, and thus, just below the work surface. A decorative grommet or cap having a hole for the passage of cords therethrough may be positioned at the first end of the cylindrical sleeve, and substantially flush with the work surface. Additionally, an opening defined through a portion of the wall of the cylindrical sleeve provides for passage therethrough of excess cable length from above the work surface to a space below the work surface.

A third embodiment of the cable management device includes a cylindrical sleeve having an outwardly depending lip at a first end, a horizontal shelf closing off a first portion of the cylindrical sleeve at a depth between the first and second ends, and a bottom end closing off a remaining portion of the cylindrical sleeve at the second end. The sleeve slides into a standard sized cable management hole and is supported by the lip at the first end substantially flush with the surface. The shelf portion and the bottom end define one or more apertures shaped to releasably receive an electrical connector such as a standard AC power cord socket or a data connector. For example, an aperture for a data connector may be defined in the shelf portion and an aperture for a power socket defined in the bottom end. Additionally, a vertical opening may be defined between the interior edge of the horizontal portion and the interior edge of the bottom portion. The opening provides for passage therethrough of excess cable length from above the work surface to the space below the work surface.

In one form, the present invention provides a device for mounting a plurality of different sized electrical connectors, including a base member; and first and second intersecting rectangular apertures defined within the base member, the intersecting apertures oriented so that a longer side of the first aperture is perpendicular to a longer side of the second aperture, the first aperture is centered on the second aperture along a first axis, and the first aperture has a side that is collinear with a side of the second aperture along a second axis.

In another form thereof, the present invention provides a cable management device including a plate defining at least one aperture adapted to releasably receive an electrical connector, the plate mountable to an underside of a surface adjacent an existing cable management hole such that the electrical connector is accessible from a top side of the surface.

In yet another form thereof, the present invention provides a cable management device for a work surface, including a sleeve adapted for mounting in a cable management hole in a work surface, the sleeve including a lip depending outwardly from a first end of the sleeve and engaging the work surface; and at least one aperture defined within the sleeve, the aperture adapted to releasably receive an electrical connector.

Advantageously, the cable management device is adapted for use with work surfaces having existing standard sized cable management holes.

A further advantage of the cable management device is that sockets or other connectors are supported just below the work surface so that temporary electrical and data connections can be made from above the work surface, yet the connected plugs and excess cable length are stored below the work surface.

An additional advantage is that the cable management device can be inexpensively constructed from a single die cut and/or molded piece of plastic or similar material.

Yet a further advantage of the cable management device is that supported electrical connectors can easily be released and others installed into the cable management device without the use of tools.

A further advantage of the cable management device is that first and second intersecting rectangular apertures provide support for a plurality of various sized data connectors and another aperture provides support for a female socket of a standard AC power cord.

BRIEF DESCRIPTION OF THE DRAWINGS

The above-mentioned and other features and advantages of this invention, and the manner of attaining them, will become more apparent and the invention will be better understood by reference to the following description of the embodiments of the invention taken in conjunction with the accompanying drawings wherein.

Figure 1:
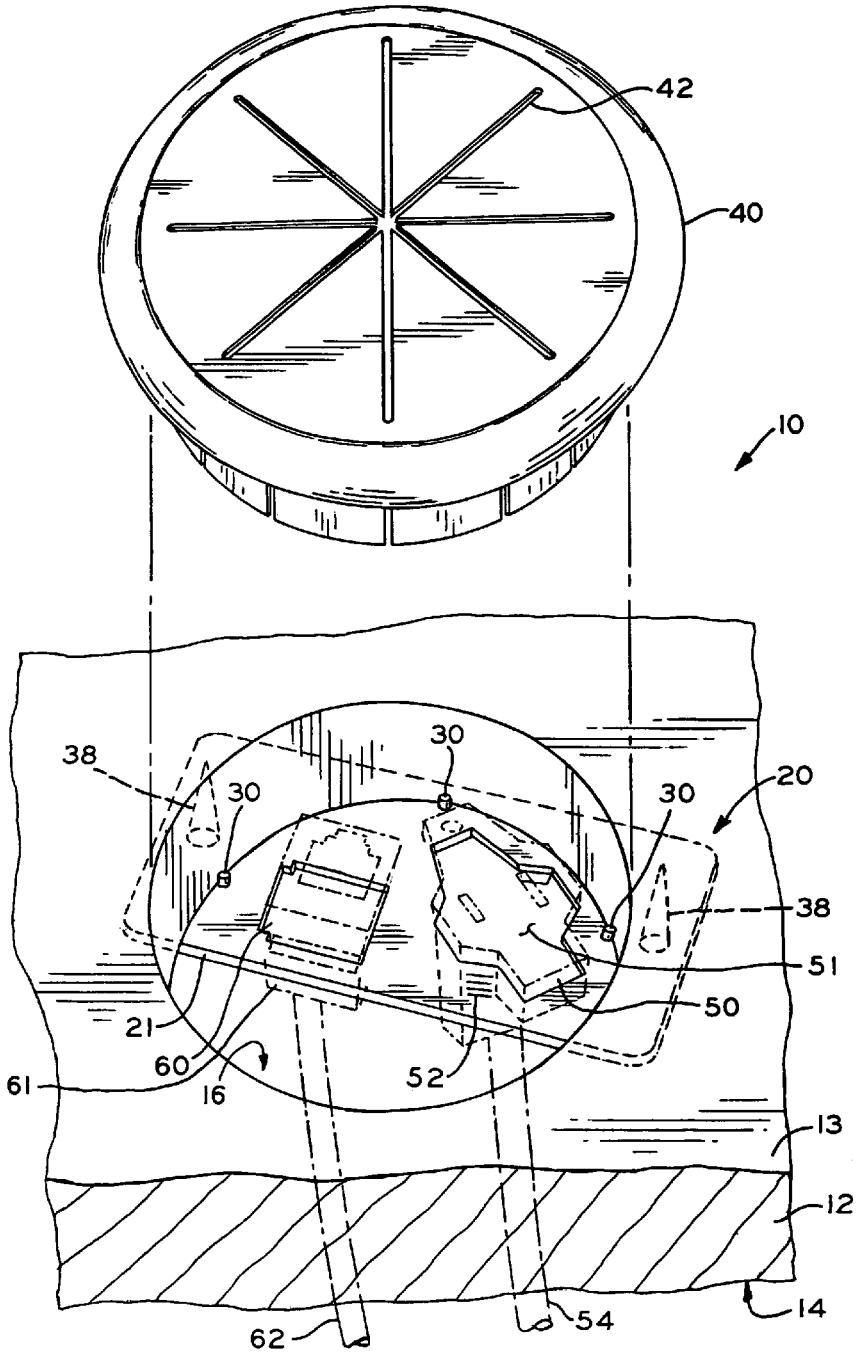
FIG. 1 is a top perspective view of a cable management device according to one form of the present invention attached below a cable management hole of a work surface.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrates preferred embodiments of the invention and such exemplifications are not to be construed as limiting the scope of the invention in any manner.

DETAILED DESCRIPTION

Referring to FIG. 1, a first exemplary embodiment of cable management device 20 of cable management system 10 supports electrical connectors 50 and 60 below cable management hole 16 in work surface 12. The supported electrical connectors 50 and 60 may be hidden from view by grommet 40, which is sized to be supported by cable management hole 16 in work surface 12.

Work surface 12 may be a top surface of a desk, bridge, return, credenza, or other work surface through which it is desirable to route electrical or data cables. Work surface 12 includes a top surface 13 and an opposite bottom surface 14. A standard cable management hole 16 is defined through work surface 12 from top surface 13 to bottom surface 14. While cable management holes 16 may be of various sizes, such holes are generally 60 millimeters (mm) or 2 and ⅜th inches in diameter.

Figure 2:
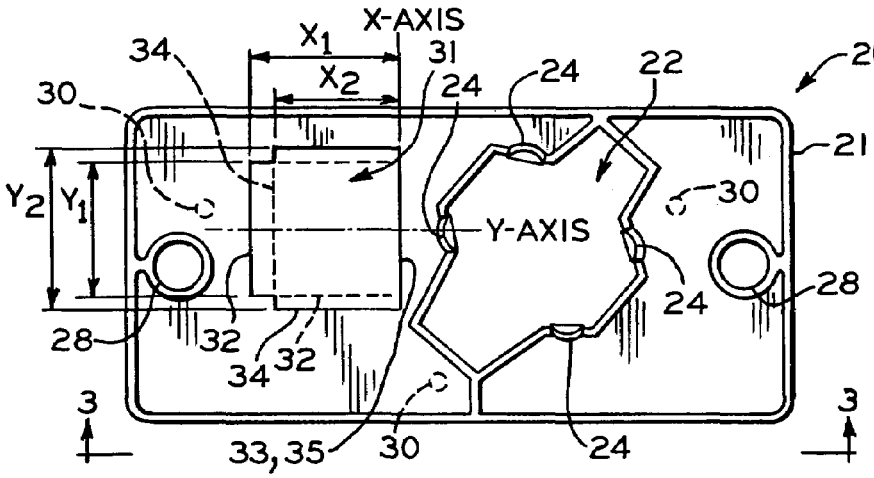
FIG. 2 is a bottom view of the cable management device of FIG. 1.

Referring to FIG. 2, cable management device 20 includes a generally flat plate 21 which may be die cut or molded from a plastic or another suitable inexpensive, yet durable material. Plate 21 defines at least one aperture therethrough for releasably receiving electrical connector 50 or 60. Power aperture 22, shown in FIG. 2, is sized to receive a power socket 50, shown in FIG. 1, such as the female end of a standard AC power cord or extension cord. The type of power cord socket 50 supported by power aperture 22 is of the type attached to one end of a standard AC power cord or extension cord having a male power plug attached to its opposite end. Such power cord sockets 50 generally include a durable and resilient plastic housing, such as housing 51 (FIG. 1), and are low cost and readily available.

Figure 3:
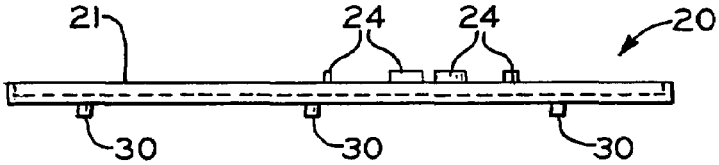
FIG. 3 is a side view taken along section lines 3—3 of the cable management device of FIG. 2.

Power aperture 22 may further include tabs 24, shown in FIGS. 2 and 3. Tabs 24 depend from the surface of plate 21 and are sloped slightly inward toward power aperture 22 so that tabs 24 grippingly engage housing ribs 52, shown in FIG. 1, of AC power cord socket 50 when socket 50 is inserted into power aperture 22. Although the exemplary embodiment includes tabs 24 for engaging socket 50, if power aperture 22 is sized smaller than socket 50, socket 50 will be trapped in position within aperture 22 by gravity. Advantageously, the arrangement of power aperture 22 allows power socket 50 to be releasably received, i.e., power socket 50 may be received within power aperture, and removed from power aperture 22, without the use of tools.

While an exemplary power aperture 22 cut-out shape for standard female AC sockets is shown, various shapes may be used according to the electrical, data, or other connector for which aperture 22 is designed to releasably receive. The exemplary cut-out of aperture 22 shown in FIG. 2 advantageously receives a wide range of standard AC power cord sockets.

Cable management device 20 may also include additional apertures defined by plate 21. For example, data aperture 31, shown in FIG. 2, is adapted for receiving a variety of data connectors 60 having housing 61, shown in FIG. 1. While data aperture 31 may be sized and shaped for releasably receiving a particular data connector, the specific arrangement shown in FIG. 2 for data aperture 31 advantageously receives a variety of data connectors 60, for example, category five data connectors manufactured by AMP, Allen Tel, AT&T, Hubbell, Krone, Lucent Technologies, and Panduit, and category three data connectors manufactured by AMP.

The exemplary data aperture 31, shown in FIG. 2, includes two intersecting rectangular apertures 32 and 34. First rectangular aperture 32 advantageously has a horizontal dimension $X_1$ of 17.8 mm and a vertical dimension $Y_1$ of 16.6 mm. Second rectangular aperture 34 advantageously has a horizontal dimension $X_2$ of 15.0 mm and a vertical dimension $Y_2$ of 19.7 mm. Each of the forgoing dimensions may vary to within about ±0.5 mm. Also, while still other dimensions could be used, it has been found by experimentation that the specific dimensions of the exemplary data aperture 31 provide releasable support for a wide range of data connectors.

The exemplary arrangement of data aperture 31 is achieved by orienting the long side $X_1$ of first rectangular aperture 32 perpendicular to the long side $Y_2$ of second data aperture 34. Additionally, while first rectangular aperture 32 is centered on second rectangular aperture 34 along the Y-axis, first rectangular aperture 32 has a side 35 along the X-axis which is shared or collinear with a side 33 of second rectangular aperture 34. The inventive arrangement described above for data aperture 31 provides the option of rotating data connector 60 ninety degrees if data connector 60 does not fit in data aperture 31 as first oriented.

Referring to FIG. 1, plate 21 of the first exemplary embodiment of data management device 20 includes three protuberances 30 depending from the side of plate 21 opposite tabs 24, as shown in FIG. 3. Protuberances 30 are arranged on plate 21 such that they aid in locating plate 21 and in turn apertures 22 and 31 relative to data management hole 16. When plate 21 is positioned so that protuberances 30 all contact the inner circumference of data management hole 16, apertures 22 and 31 will be located in line with data management hole 16 such that electrical connectors 50 and 60 can be supported within plate 21 and are accessible through cable management hole 16. Plate 21 further defines mounting holes 28 for fasteners 38 (FIG. 1), for example screws, that fasten cable management device 20 to bottom surface 14 of work surface 12.

After cable management device 20 is secured to work surface 12, power socket 50 and data connector 60 are easily accessible from above work surface 12. Thus, power cord plugs and data cable connectors can be connected to each of power socket 50 and data connector 60 without having to access the space under work surface 12. Additionally, power socket 50 and data connector 60 may be removed and a new socket or connector installed in its place without removing plate 21 from work surface 12.

Figure 4:
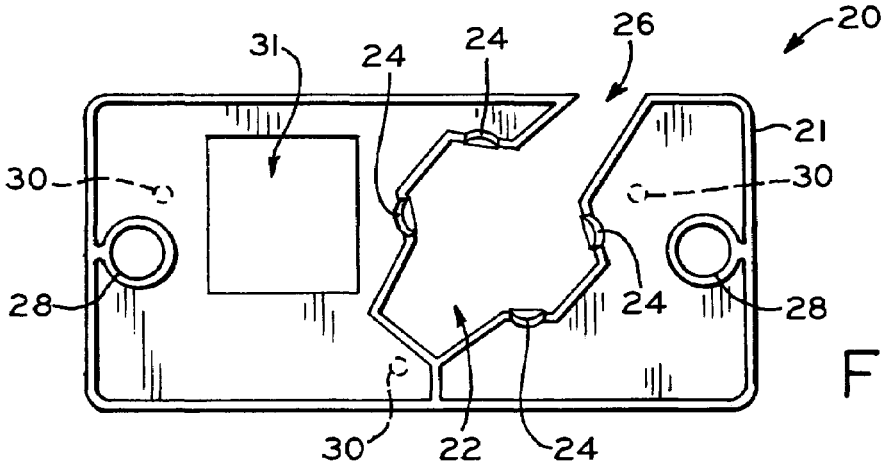
FIG. 4 is an alternative embodiment of the cable management device shown in FIG. 2.

Referring to FIG. 4, an alternative power aperture 22 and data aperture 31 are shown for the first embodiment of cable management device 20. Specifically, power aperture 22 is shown having slot 26 defined by and extending to the edge of plate 21. Advantageously, slot 26 allows the power cord 54 (FIG. 1) of power socket 50 to slide through slot 26 so that power socket 50 may be more expeditiously inserted or removed from power aperture 22. Data aperture 31 is shown as a square-shaped aperture sized to receive a particular sized data connector 60. However, the data aperture discussed above which is dimensioned to receive a variety of differently shaped data connectors 60 may be alternatively used.

Figure 5:
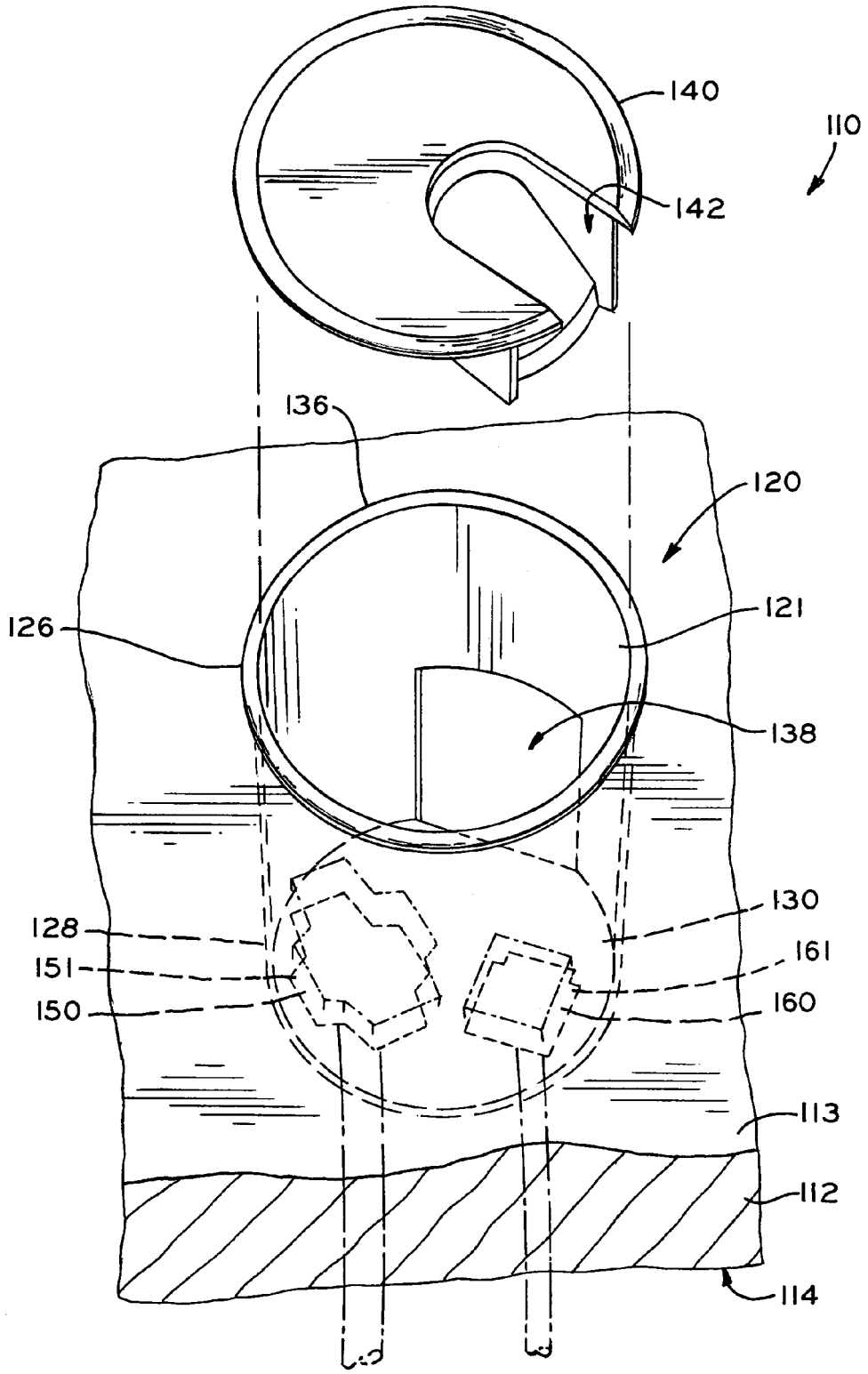
FIG. 5 is a top perspective view of a second embodiment of a cable management device of the present invention shown positioned in a cable management hole of a work surface and having an AC power cable and socket and data cable and connector mounted thereto.
Figure 6:
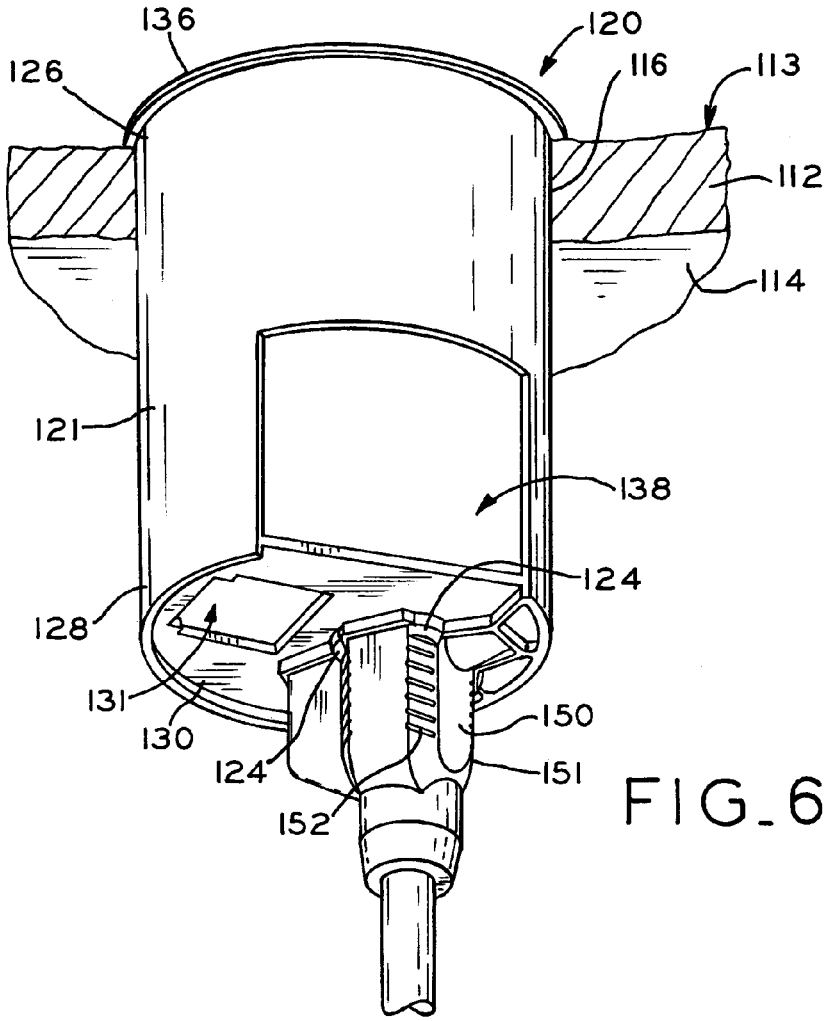
FIG. 6 is a bottom perspective view of the cable management device of FIG. 5.
Figure 7:
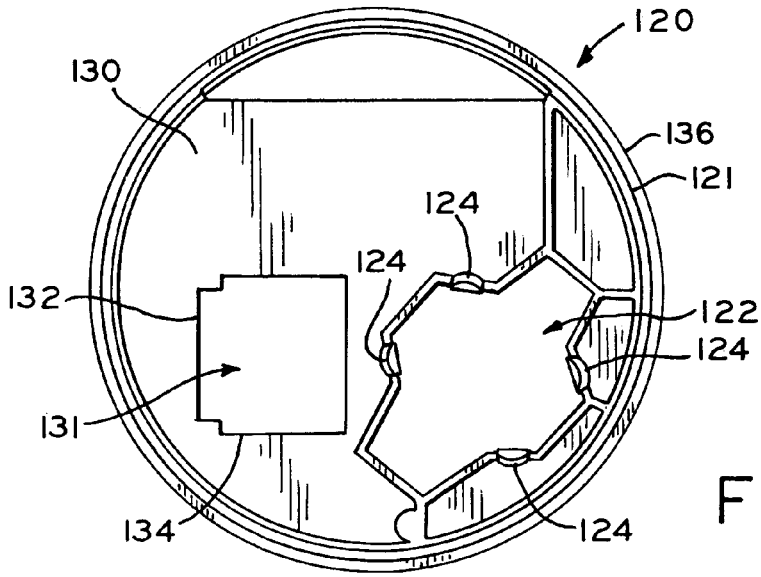
FIG. 7 is a bottom plan view of the cable management device of FIG. 5.

A second exemplary embodiment of cable management system 110, shown in FIGS. 5–7, includes cable management device 120 having sleeve 121 extending through cable management hole 116 defined in work surface 112. Although the exemplary embodiment of cable management device 120 has a cylindrically shaped sleeve 121, other shaped sleeves, for example oval or rectangular, may be used, or sleeve 121 may include a cylindrical portion extending through cable management hole 116 and a differently shaped portion extending from the cylindrical portion.

Cable management device 120 includes at least one aperture 122, 131 (FIG. 7) defined by sleeve 121. In the exemplary embodiment shown in FIG. 5, cylindrical sleeve 121 includes a first end 126 and a second end 128, with second end 128 having a bottom end surface 130 closing second end 128 of cylindrical sleeve 121. In the exemplary second embodiment, bottom end 130, as shown in FIG. 7, defines power aperture 122 and data aperture 131 for releasably receiving housing 151 of power connector 150 and housing 161 of data connector 160, as shown in FIGS. 5 and 6.

Referring to FIG. 6, first end 126 of cylindrical sleeve 121 includes lip 136 depending outwardly and for retaining cable management device 120 against upper surface 113 of work surface 112. Cylindrical sleeve 121 extends well below bottom surface 114 of work surface 112 in the exemplary embodiment. Advantageously, the length of cylindrical sleeve 121 provides for opening 138 defined in a portion of cylindrical sleeve 121 and for electrical and data cable connectors that are plugged into connectors 150 and 160 to be contained below upper surface 113 in cable management device 120. Cable opening 138 allows surplus length of the power or data cables that are plugged into connectors 150 and 160 to be pushed from above surface 112 down through cable opening 138 defined by cylindrical sleeve 121 and into the space below work surface 112.

Referring again to FIG. 5, decorative cap 140 having cable slot 142 may be used to cover cable management device 120 and the various sockets and cables supported and contained within device 120.

Referring again to FIGS. 6 and 7, power aperture 122 may include the features of power aperture 22 disclosed above in the first embodiment. For example, power aperture 122 may include tabs 124 for grippingly engaging ribs 152 of AC power socket 150. Similar to data aperture 31 disclosed above with respect to the first embodiment, data aperture 131 may be advantageously defined by two intersecting rectangular apertures 132 and 134 to receivingly support a number of various sized data connectors 150.

Figure 8:
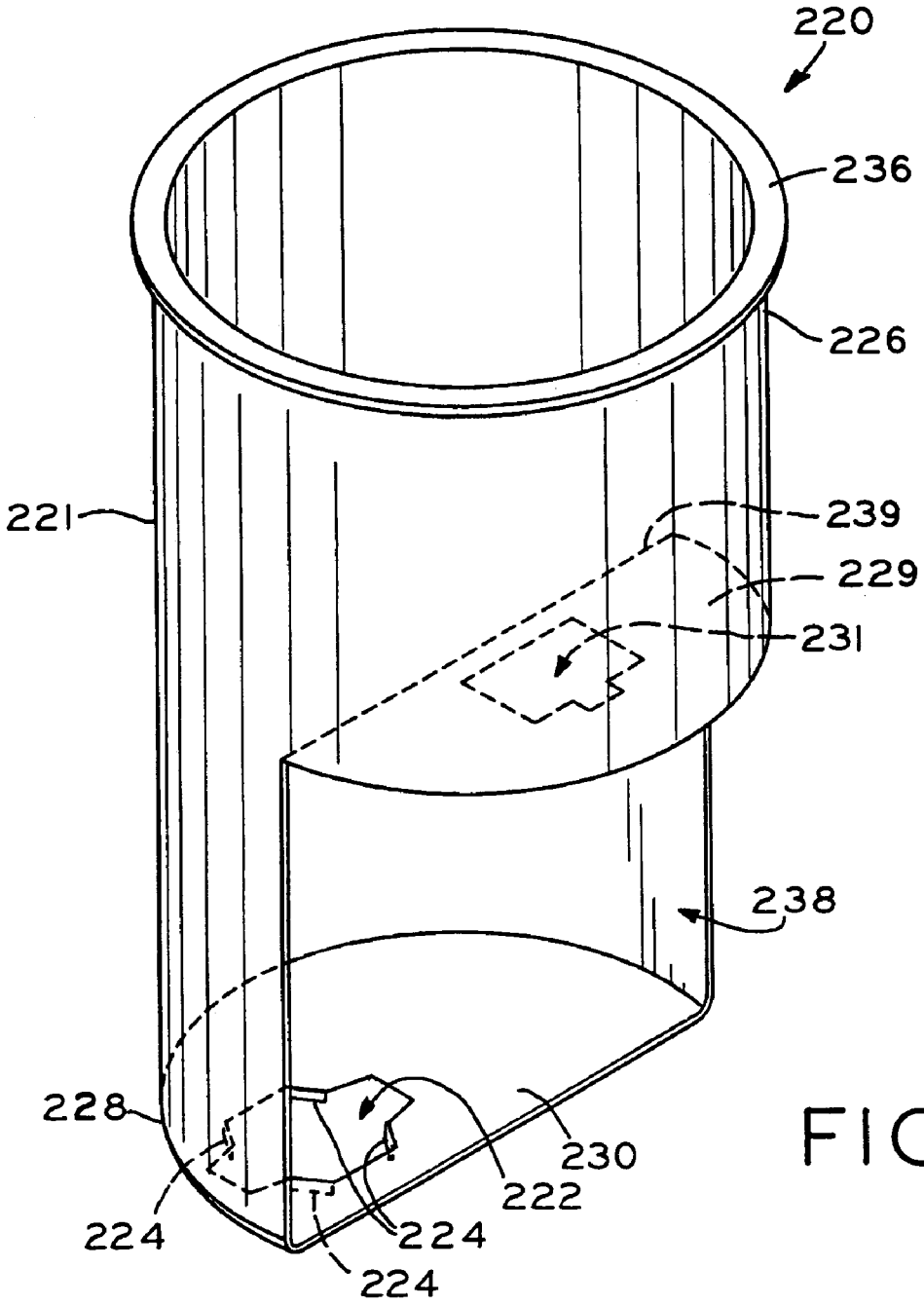
FIG. 8 is a top perspective view of a third embodiment of a cable management device of the present invention.
Figure 9:
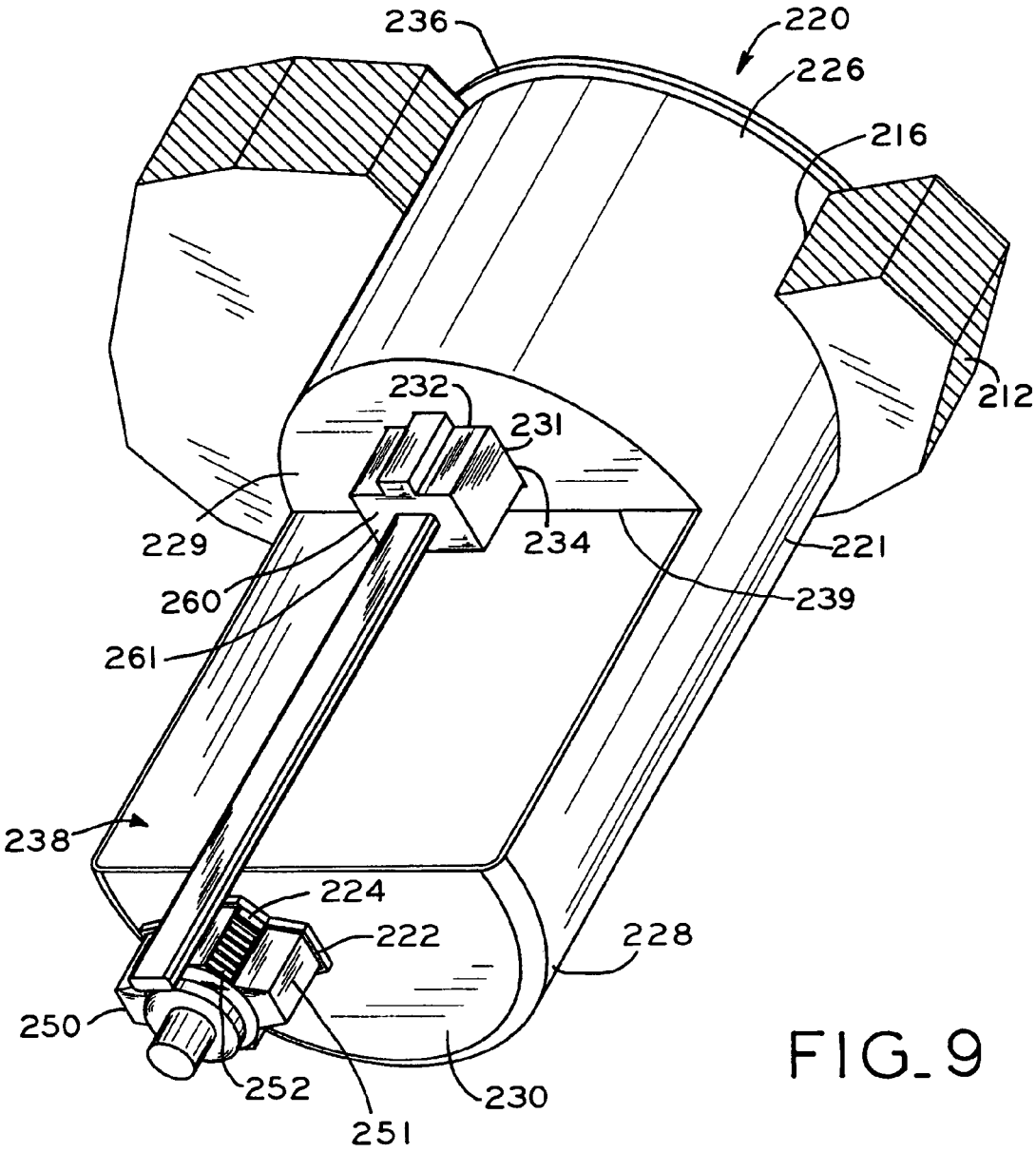
FIG. 9 is a bottom perspective view of the cable management device of FIG. 8, shown positioned in a cable management hole of a work surface and having an AC power cable and socket and data cable and connector mounted thereto.

A third exemplary embodiment of cable management device 220, shown in FIGS. 8 and 9, includes sleeve 221 which is generally cylindrical shaped and includes lip 236 at a first end 226, and a second end 228. Lip 236 is capable of supporting device 220 in cable management hole 216 of work surface 212, as shown in FIG. 9.

Between first end 226 and second end 228, horizontally oriented shelf 229 truncates and closes a portion of the circular cross-section formed by cylinder 221. The remaining portion of the circular cross-section of sleeve 221 is closed by bottom end 238 at second end 228 of sleeve 221. The vertical plane formed between interior edge 239 of horizontal portion 229 and bottom end 230 may be open, forming opening 238. Opening 238 allows surplus length of power and data cables to be pushed from above surface 212 down through cable opening 238 defined by cylindrical sleeve 221 into the space below work surface 212.

Shelf 229 and bottom end 230 may define one or more apertures 222 and 231. In the exemplary embodiment shown in FIGS. 8 and 9, cylindrical sleeve 121 defines power aperture 222 in bottom end 230 and data aperture 231 in shelf 229. This arrangement provides for easier access to housing 261 (FIG. 9) of smaller data connector 260 as it is located closer to first end 226 and the top of work surface 212. Additionally, by locating housing 251 (FIG. 9) of power socket 250 in bottom end 230, the mating power plug and larger diameter cord extending from it (not shown) is provided the full length of cylindrical sleeve 221 for bending the cord as required to extend through opening 238. Shelf 229 defining data aperture 231 may be located at a convenient distance between first end 226 and second end 228 so that data connector 260 is readily accessible from work surface 212, e.g. approximately 30 mm from first end 226.

Power aperture 222 may also include other features of power apertures 22 and 122 discussed above. For example, power aperture 222 may include tabs 224 for grippingly engaging ribs 252 of AC power socket 250. Similar to data apertures 31 and 131 discussed above, data aperture 231 may be advantageously defined by two intersecting rectangular apertures 232 and 234 to receivingly support a number of various sized data connectors 250.

While this invention has been described as having exemplary embodiments and scenarios, the present invention can be further modified within the spirit and scope of this disclosure. This application is therefore intended to cover any variations, uses, or adaptations or the invention using its general principles. Further, this application is intended to cover such departures from the present disclosure as come within known or customary practice in the art to which this invention pertains and which fall within the limits of the appended claims.

What is claimed is:

1. A device for mounting a plurality of different sized electrical connectors, comprising:

a base member; and first and second intersecting rectangular apertures defined within said base member, said intersecting apertures oriented so that a longer side of said first aperture is perpendicular to a longer side of said second aperture, said first aperture is centered on said second aperture along a first axis, and said first aperture has a side that is collinear with a side of said second aperture along a second axis.

2. The device of claim 1, wherein said base member includes at least one protuberance for aligning said first and second rectangular apertures with a work surface cable management hole.

3. The device of claim 2, wherein said base member further comprises a sleeve defining a lip at a first end, and said at least one protuberance comprises said sleeve and said lip.

4. The device of claim 1, wherein said longer side of said first aperture is shorter than said longer side of said second aperture and said shorter side of said first aperture is longer than said shorter side of said second aperture.

5. The surface of claim 1, wherein said first aperture measures 17.8 mm by 16.6 mm and said second aperture measures 15.0 mm by 19.7 mm.

6. A work surface, comprising:

a cable management hole;

a plate defining an aperture adapted to releasably receive an electrical connector, said electrical connector comprising the power socket of an alternating current power cord, said plate further including at least one tab capable of grippingly engaging said alternating current power socket;

at least one fastener securing said plate to an underside of said work surface adjacent said cable management hole with said aperture substantially aligned with said cable management hole; and a grommet supported within said cable management hole, said grommet substantially covering said plate.

7. The work surface of claim 6, further comprising an opening defined by said plate, said opening connecting said aperture to an outside edge of said plate, thereby allowing said aperture to receive said alternating current power cord whereby said alternating current power socket is seated within said aperture by moving said alternating current power socket toward said opening.

8. The work surface of claim 6, wherein said plate includes at least one protuberance aligning said aperture with said cable management hole.

9. A work surface, comprising:

a cable management hole, a plate defining an aperture adapted to releasably receive an electrical connector, said electrical connector comprising a data connector, said aperture including first and second intersecting rectangular apertures sized and arranged to accept any one of a plurality of different sized data connectors;

at least one fastener securing said plate to an underside of said work surface adjacent said cable management hole with said aperture substantially aligned with said cable management hole; and a grommet supported within said cable management hole, said grommet substantially covering said plate.

10. The work surface of claim 9, wherein said intersecting apertures are oriented so that a longer side of said first aperture is perpendicular to a longer side of said second aperture, said first aperture is centered on said second aperture along a first axis, and said first aperture having a side collinear with a side of said second aperture along a second axis.

11. The work surface of claim 10, wherein said longer side of said first aperture is shorter than said longer side of said second aperture and said shorter side of said first aperture is longer than said shorter side of said second aperture.

12. A work surface, comprising:

a cable management hole;

a sleeve mounted in said cable management hole, said sleeve including a lip depending outwardly from a first end of said sleeve and engaging said work surface;

said sleeve further including a lower wall having at least one aperture adapted to releasably receive a housing of an electrical connector;

a shelf surface truncating and closing a portion of said sleeve between said first end and said lower wall; and said shelf surface defining at least one aperture sized to releasably receive a data connector.

13. The work surface of claim 12, wherein said sleeve is cylindrical.

14. The work surface of claim 12, further comprising an opening defined along a portion of the length and circumference of said sleeve adjacent said lower wall.

15. The work surface of claim 12, wherein said electrical connector comprises an alternating current power socket which is coupled to an alternating current power cord.

16. The work surface of claim 15, wherein said lower wall comprises at least one tab capable of grippingly engaging said alternating current power socket.

17. The work surface of claim 12, further comprising an opening defined by said sleeve between said shelf surface and said lower wall.

18. The work surface of claim 12, wherein said electrical connector comprises a data connector.

19. The work surface of claim 18, wherein said aperture comprises first and second intersecting rectangular apertures sized and arranged to accept any one of a plurality of different sized data connectors.

20. The work surface of claim 19, wherein said intersecting apertures are oriented so that a longer side of said first aperture is perpendicular to a longer side of said second aperture, said first aperture is centered on said second aperture along a first axis, and said first aperture having a side collinear with a side of said second aperture along a second axis.

21. The work surface of claim 20 wherein said longer side of said first aperture is shorter than said longer side of said second aperture and said shorter side of said first aperture is longer than said shorter side of said second aperture.

22. The work surface of claim 19, wherein said first aperture is 17.8 mm by 16.6 mm and said second aperture is 15.0 mm by 19.7 mm.

* * * * *